US006360847B1

(12) United States Patent
Okada et al.

(10) Patent No.: US 6,360,847 B1
(45) Date of Patent: Mar. 26, 2002

(54) ELEVATOR SYSTEM AND SPEED GOVERNING APPARATUS

(75) Inventors: Mineo Okada; Yoshikatsu Hayashi, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/563,149

(22) Filed: May 2, 2000

(30) Foreign Application Priority Data

May 17, 1999 (JP) ..... 11-135084

(51) Int. Cl.[7] ..... B66B 5/04
(52) U.S. Cl. ..... 187/373
(58) Field of Search ..... 187/305, 373, 187/374, 375, 376

(56) References Cited

U.S. PATENT DOCUMENTS 3,327,811 A * 6/1967 Mastroberte ..... 187/38
5,183,979 A * 2/1993 Sheridan et al. ..... 187/108
5,299,661 A * 4/1994 Pramanik et al. ..... 187/89
5,323,878 A * 6/1994 Nakamura et al. ..... 187/109
5,516,723 A * 5/1996 Luebke ..... 187/244
5,653,312 A 8/1997 Kato

FOREIGN PATENT DOCUMENTS

JP 64-13388 1/1989
JP 3-177283 8/1991

OTHER PUBLICATIONS

"Safety Code of Elevators and Escalators", *The American Soc. of Mechanical Engineers,* p. 67, 1987.

* cited by examiner

*Primary Examiner*—Thomas J. Brahan
(74) *Attorney, Agent, or Firm*—Leydig, Voit, & Mayer, Ltd.

(57) ABSTRACT

An elevator system and a speed governor detecting first over-speeds of different values set for different moving directions of an elevator car. The speed governor includes a fly weight speed governing mechanism on a sheave on which a speed governing rope is wound and operates in both ascending and descending modes of the elevator car, and a fly ball speed governing mechanism coupled with a horizontal shaft of the sheave via a clutch mechanism. The clutch mechanism transmits the torque of the sheave to a second shaft of the fly ball speed governing mechanism when the sheave rotates in a forward direction, and disengages the transmission of the torque to the second shaft when the sheave rotates in a reverse direction.

18 Claims, 12 Drawing Sheets

ELEVATOR SYSTEM AND SPEED GOVERNING APPARATUS

BACKGROUND OF THE INVENTION

1. Field of the Invention

The present invention relates to a speed governing apparatus that detects over-speed of an ascending/descending member, such as an elevator car or a counterweight, and stops the ascending/descending member, and an elevator system having the speed governing apparatus.

2. Description of Related Art

FIG. 1 is a longitudinal sectional view showing a conventional fly ball type speed governor disclosed in, for example, Japanese Unexamined Patent Publication No. 3-177283.

A system shown in FIG. 1 has a machine room 1 provided right above a hoistway, a speed governor 2 installed on the machine room 1, and an endless speed governing rope 3 which is disposed in the hoistway and one end of which is coupled to an ascending/descending member (not shown).

The system further includes a support member 4 of the speed governor 2, a horizontal shaft 5 rotatably held by the support member 4, a sheave 6 which is secured to the horizontal shaft 5 and onto which an upper end curved portion of the speed governing rope 3 has been wound, a perpendicular shaft 7 rotatably held above the support member 4, a driving bevel gear 8 that is secured to the horizontal shaft 5 and concentrically disposed to a rotational center of the sheave 6, and a driven bevel gear 9 that is secured to the perpendicular shaft 7 and in engagement with the driving bevel gear 8.

Reference numeral 10 denotes a well-known fly ball type speed governing mechanism provided on the perpendicular shaft 7. The fly ball speed governing mechanism 10 includes arms 11 having their upper ends pivotally held by an upper end portion of the perpendicular shaft 7, fly balls 12 secured to lower ends of the arms 11, a slide cylinder 13 fitted onto the perpendicular shaft 7, links 14 having both ends pivotally mounted on middle portions of the arms 11 and on the slide cylinder 13, and a balance spring 15 which is composed of a compression coil spring fitted to the perpendicular shaft 7 and disposed between the upper end of the perpendicular shaft 7 and the slide cylinder 13 to urge the slide cylinder 13 downward.

A driven cylinder 16 is fitted onto the perpendicular shaft 7, and pivotally attached to the slide cylinder 13 so that it is vertically moves as the slide cylinder 13 vertically moves; however, it does not rotate about the perpendicular shaft 7. A stop switch 17 is secured to the support member 4 and turns OFF the power of a driving unit (not shown) for driving the ascending/descending member. An operating lever 18 is secured to the driven cylinder 16 to operate the stop switch 17 as the driven cylinder 16 ascends.

The conventional fly ball type speed governor is disposed and constructed as described above, and as the ascending/descending member ascends or descends, the movement of the speed governing rope 3 causes the sheave 6 to rotate. This rotation is transmitted to the perpendicular shaft 7 via the driving bevel gear 8 and the driven bevel gear 9. The fly balls 12 revolve according to a rotational speed of the perpendicular shaft 7, and move up against the urging force of the balance spring 15 due to a centrifugal force.

As the fly balls 12 rise, the slide cylinder 13 and the driven cylinder 16 are displaced upward. If the rotational speed of the perpendicular shaft 7, that is, the ascending or descending speed of the ascending/descending member, exceeds a rated speed and reaches a first over-speed (the first over-speed is defined by the rated speed and represented by the code as ASME/ANSI A17.1-1987 SAFETY CODE FOR ELEVATORS AND ESCALATORS), the stop switch 17 is operated by the operating lever 18 to cut off the power of the driving unit of the ascending/descending member to thereby stop the ascending/descending member. If the ascending/descending member should be further over-speed downward due to some cause and reach a second over-speed from the first over-speed, an emergency stop unit (not shown) of the ascending/descending member is actuated, although detailed descriptions and illustrations thereof will be omitted.

FIG. 2 is a front view showing a conventional fly weight type speed governor disclosed in, for example, Japanese Unexamined Patent Publication No. 6-1564. FIG. 3 is a cross-sectional view of the fly weight type speed, governor.

The speed governor shown in the drawings include a base 21 having a U-shaped cross section, bearing boxes 22 which are disposed on side walls of the base 21 and in which bearings 23 are provided, a shaft 5 having its both ends rotatably supported by the bearings 23, a sheave 6 secured to the shaft 5, and fly weights 26 which are arranged to face each other on side surfaces of the sheave 6 via the shaft 5 and pivotally attached to the sheave 6, and weight sides thereof are rotationally displaced in a direction orthogonal to an axis of the shaft 5.

A balance spring 27 has one end thereof in engagement with an anti-weight side of the fly weight 26, while the other end thereof in engagement with a side surface of the sheave 6, and acts against a displacement of the fly weight 26 caused by the centrifugal force produced when the sheave 6 rotates. An actuating hook 28 is provided on the same side of the fly weight 26 where the balance spring 27 is in engagement. An actuating member 29 is composed of a bolt screwed in the weight side of the fly weight 26. A link 210 has its both ends disposed on opposite sides from each other with respect to pivoting points of the two fly weights 26.

A stop switch 211 is mounted on a base 21 and has an actuating assembly 212 opposed to the actuating member 29.

A ratchet 213 is rotatably held by the shaft 5 and disposed to face against the actuating hook 28. A brake arm 214 has its lower end pivotally attached to the base 21 and has a brake piece 215 attached to its middle portion. An actuating bar 216 has one end thereof pivotally attached in the vicinity of the rim of the ratchet 213, and a threaded bar on the other end thereof is movably inserted in an upper end portion of the brake arm 214, a spring shoe 217 being held by a nut 218 at an insertion end.

A compression coil spring 219 is fitted onto the screwed bar of the actuating bar 216, and disposed between the brake arm 214 and the spring shoe 217. The speed governing rope 3 is wound around the sheave 6, and one end thereof is retained on an ascending/descending member, such as a car, of an elevator system provided in a hoistway, although not shown in the drawings.

The conventional fly weight type speed governor is constructed as described above, and the sheave 6 rotates by being driven by the speed governing rope 3 that moves together with the ascending/descending member. As the sheave 6 rotates, the fly weights 26 revolve together with the sheave 6, and if the rotational speed of the sheave 6, that is, the speed of the ascending/descending member, reaches a first over-speed (the first over-speed is defined by the rated speed and represented by the code as ASME/ANSI A17.1-

1987 SAFETY CODE FOR ELEVATORS AND ESCALATORS) that exceeds a predetermined value, a centrifugal force causes a rotational displacement of the fly weights 26 against the urging force of the balance spring 27. The rotational displacement of the fly weights 26 causes the actuating member 29 to press the actuating assembly 212 of the stop switch 211. This actuates the stop switch 211 to cut off the power of the driving unit of the elevator system so as to stop the ascending/descending member, thus preventing an accident caused by the occurrence of the first over-speed.

However, in case of an accident, such as breakage of a main rope of the elevator system, the ascending/descending member continues to descend even when the driving unit is stopped. In this case, if the ascending/descending member reaches a second over-speed (the second over-speed is defined by the rated speed and represented by the code as ASME/ANSI A17.1-1987 SAFETY CODE FOR ELEVATORS AND ESCALATORS), the actuating hook 28 engages a hook of the ratchet 213 due to the rotational displacement of the fly weights 26 produced by the centrifugal force against the urging force of the balance spring 27. As a result, the ratchet 213 circularly moves in the same direction in which the sheave 6 rotates, so that the actuating bar 216 is displaced, and, the brake arm 214 is moved via the compression coil spring 219 in the same direction in which the sheave 6 rotates. The brake piece 215 pushes the speed governing rope 3 against the sheave 6 to brake the descent of the speed governing rope 3. The brake of the speed governing rope 3 actuates the emergency stop unit of the ascending/descending member to bring the ascending/descending member to a halt. Hereinafter, a stopping operation of the driving unit and a stopping operation of the ascending/descending member by the emergency stop unit will be referred to as "an emergency stopping operation" of an elevator car.

In the conventional fly ball type or the fly weight type speed governor as described above, the rotational direction of the sheave 6 changes according to the operating direction of the ascending/descending member. On the other hand, the centrifugal force produced in the fly balls 12 or the fly weights 26 is always in a direction opposite from the direction of the axial center of the perpendicular shaft 7 or the sheave 6 independently of the rotational direction of the sheave 6. Therefore, the amount of an upward displacement of the driven cylinder 16 or the amount of a rotational displacement of the fly weights 26 caused by the over-speed of the ascending/descending member is determined by an absolute value of the speed of the ascending/descending member. Hence, it is impossible to set different first over-speeds for different operating directions of the ascending/descending member.

There are some countries that have established regulations requiring that a vertical distance from a floor surface of the lowest level at which a car stops to a bottom floor surface of a hoistway, i.e., a pit depth, be set to not less than a value determined according to a rated speed of an elevator. This is because a size of a shock absorber installed in the pit differs according to rated speed. If, on the other hand, a pit depth is limited because of an architectural reason, then the rated speed of an elevator must be set to a value or less decided based on the pit depth. There is a demand, however, for setting only the rated speed for ascending, which is irrelevant to a possibility of a collision with the shock absorber, at a speed greater than a rated speed for descending in order to achieve efficient transportation.

However, if the conventional elevator speed governor is used that is capable of detecting only the same first over-speed regardless of the moving direction of the ascending/descending member as described above, then it would be impossible to exceed a maximum tolerance of a first over-speed specified by the regulations because of the rated speed in the descending direction, even when a rated speed for ascending is set to be higher than a rated speed for descending.

A sudden change in pressure in a car owing to high-speed operation causes uncomfortable feeling in passengers' ears. This uncomfortable feeling is known to be more noticeable when the car descends than when it ascends. From this aspect also, demands arise for elevators having different rated speeds for ascending and descending.

SUMMARY OF THE INVENTION

The present invention has been made with a view toward solving the problems described above, and it is an object of the invention to provide an elevator system and a speed governing apparatus capable of detecting different values of first over-speed, depending on a moving direction of an elevator car.

According to one aspect of the present invention, there is provided an elevator system having: an elevator car that moves in a hoistway; a driving machine unit for moving the elevator car up and down via a cable; a control unit that controls the driving machine unit such that a moving speed at which the elevator car ascends is different from a moving speed at which the elevator car descends; and a speed governing unit for controlling a moving speed of the elevator car; wherein the speed governing unit has a first speed governing mechanism for detecting a moving speed of the elevator car when the elevator car ascends, and a second speed governing mechanism for detecting a moving speed of the elevator car when the elevator car descends; and speed control by the first speed governing mechanism or the second speed governing mechanism is invalidated, depending upon a moving direction of the elevator car.

In a preferred form of the present invention, the speed governing unit has a speed governing rope connected to the elevator car, a sheave on which the speed governing rope is wound and which rotates in a forward direction or a reverse direction as the elevator car moves up or down, and a transmitting mechanism for controlling engagement and disengagement of transmission of a torque of the sheave to the first speed governing mechanism or the second speed governing mechanism according to a rotational direction of the sheave.

In another preferred form of the present invention, a first over-speed in an ascending mode and a first over-speed in a descending mode are set as threshold values for starting an emergency stop operation of the elevator car, a value of the first over-speed in the ascending mode and a value of the first over-speed in the descending mode are different from each other, and the first speed governing mechanism detects the first over-speed in the ascending mode, while the second speed governing mechanism detects the first over-speed in the descending mode.

In a further preferred form of the present invention, a second over-speed in the descending mode is set to a value as a threshold value for starting the emergency operation of the elevator car that is larger than the value of the first over-speed in the descending mode, and the second speed governing mechanism detects the second over-speed in the descending mode.

In yet another preferred form of the present invention, the first over-speed V1 in the ascending mode, the first over-speed V2 in the descending mode, and the second over-speed V3 in the descending mode have a relationship represented by V1>V3>V2.

In a further preferred form of the present invention, the first over-speed V1 in the ascending mode, the first over-speed V2 in the descending mode, and the second over-speed V3 in the descending mode have a relationship represented by V3>V1>V2.

In a further preferred form of the present invention, the speed governing unit has a speed governing rope, a sheave on which the speed governing rope is wound and which rotates as the speed governing rope moves, a first speed governing mechanism that governs a rotational speed of the sheave, and a second speed governing mechanism that controls a rotational speed of the sheave when the sheave rotates in a forward direction, while it stops speed control when the sheave rotates in a reverse direction.

In a further preferred form of the present invention, the sheave and the second speed governing mechanism are connected via a transmitting mechanism for transmitting the rotation of the sheave, and the transmitting mechanism transmits the rotation of the sheave to the second speed governing mechanism when the sheave rotates in the forward direction, while the transmitting mechanism disengages the transmission of the rotation of the sheave to the second speed governing mechanism when the sheave rotates in the reverse direction.

In a further preferred form of the present invention, the first speed governing mechanism is a fly weight type speed governor.

In a further preferred form of the present invention, the second speed governing mechanism is a fly ball type speed governor.

In a further preferred form of the present invention, the transmitting mechanism is a clutch coupled between a rotating shaft of the sheave and a rotating shaft of the second speed governing mechanism.

DESCRIPTION OF THE PREFERRED EMBODIMENTS

Embodiments of the present invention will now be described with reference to the accompanying drawings.

First Embodiment

Figure 4:
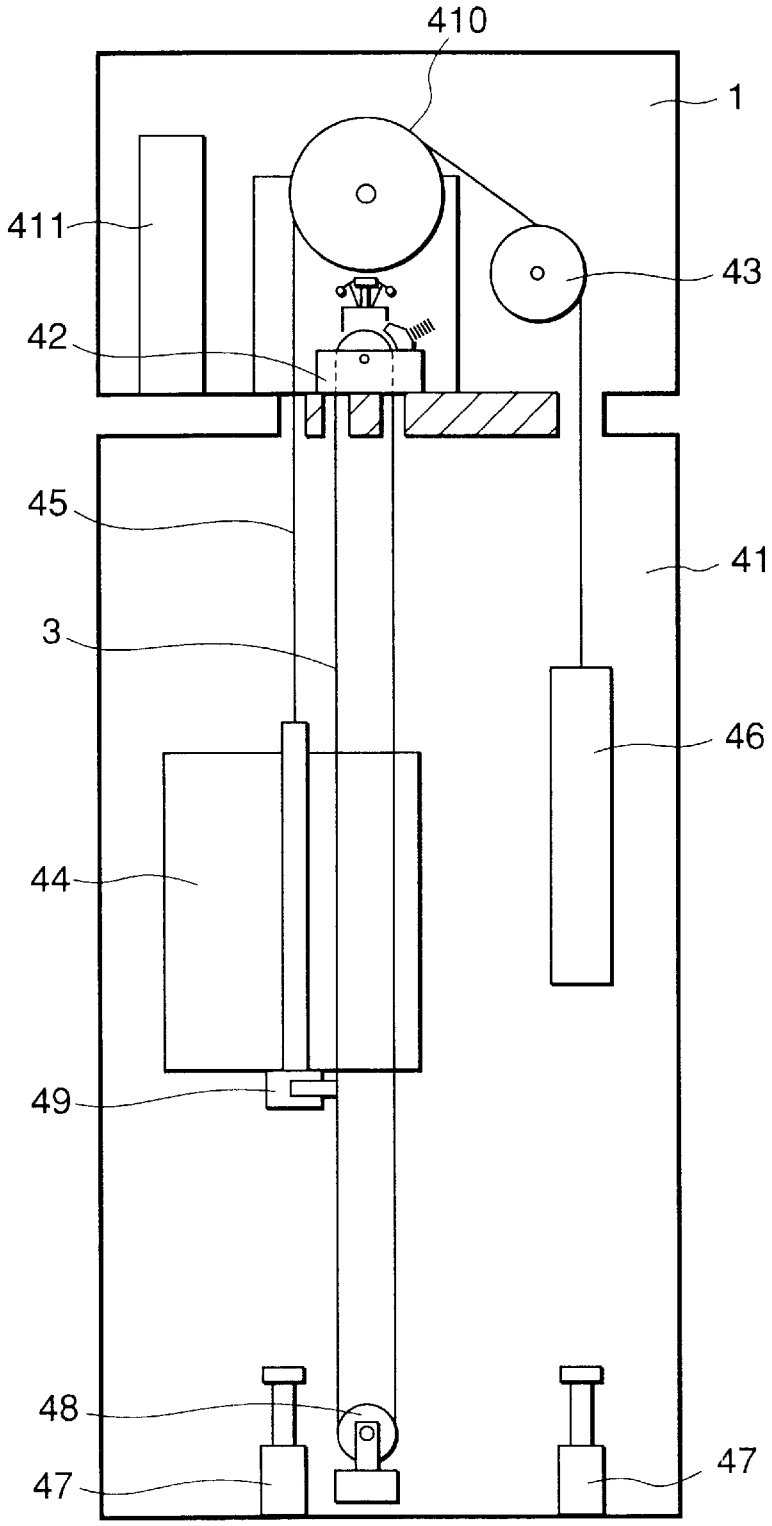
FIG. 4 is a configuration diagram showing an entire elevator system in a first embodiment.

FIG. 4 is a diagram showing an entire configuration of an elevator system in this embodiment.

Referring to FIG. 4, the elevator system according to the first embodiment includes a machine room 1, a hoistway 41, a speed governor 42 in this embodiment that is provided in the machine room, a deflector sheave 43, a car 44 guided up and down in the hoistway, a hoist rope or a main rope 45 that suspends the car 44, and a counterweight 46 suspended on the hoist rope 45 on the opposite end from the end where the car 44 is suspended.

The elevator system further includes shock absorbers 47 for the car 44 and the counterweight 46 that are installed in a pit of the hoistway, a tension sheave 48 on which an endless speed governing rope 3 is wound, an emergency stop unit 49 connected by the speed governing rope 3 and an arm, and a hoisting machine 410 on which the hoist rope 45 is wound and which functions as a driving machine unit for moving the car 44 up and down in the hoistway as a sheave of the hoisting machine 410 rotates.

A control unit 411 is installed in the machine room 1. The control unit 411 controls the rotation of the hoisting machine 410 to move the car 44 up or down at a set ascending or descending speed. The ascending speed and the descending speed are set so that they are different from each other.

Figure 5:
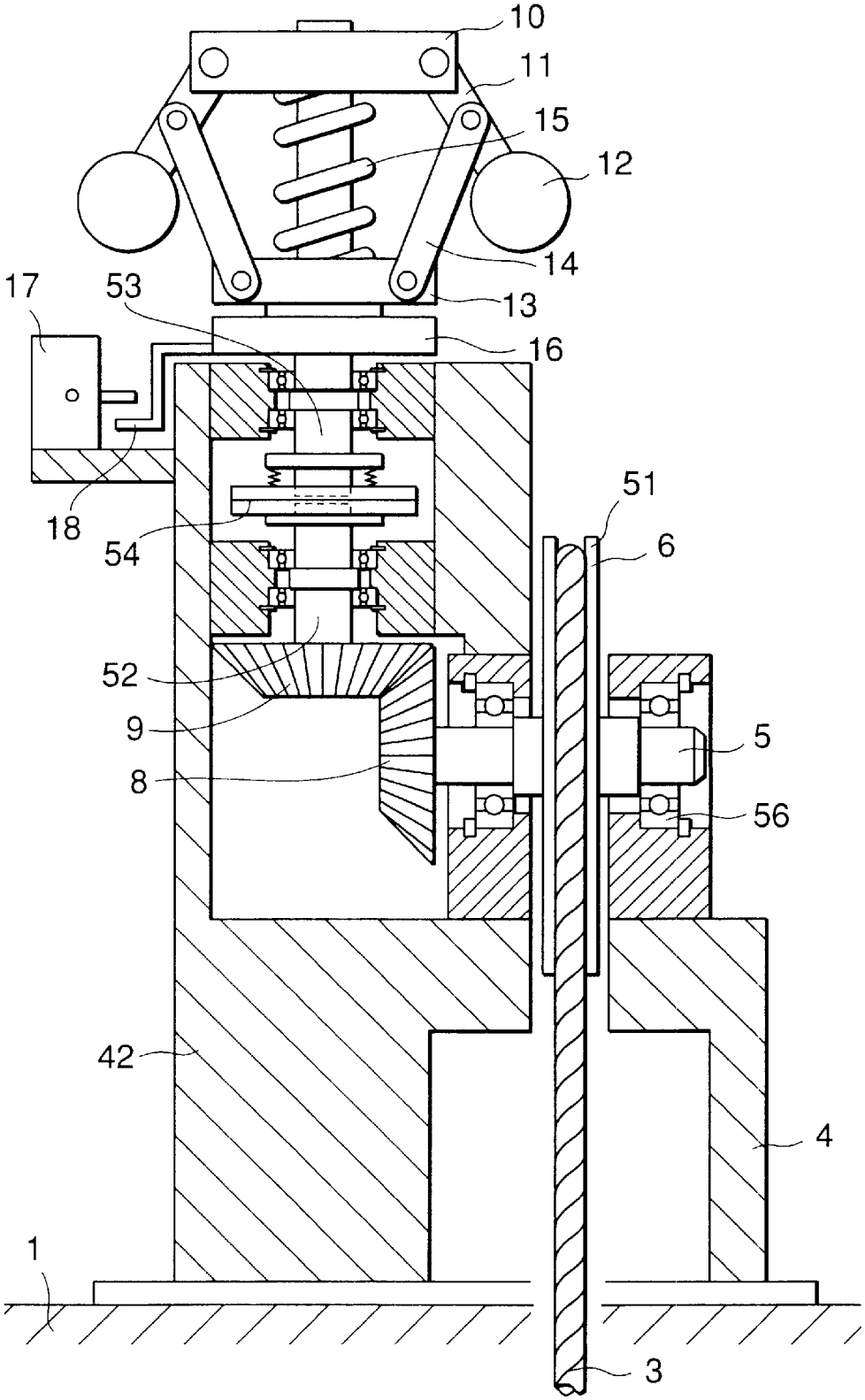
FIG. 5 is a longitudinal sectional view of an elevator speed governor in the first embodiment.
Figure 6:
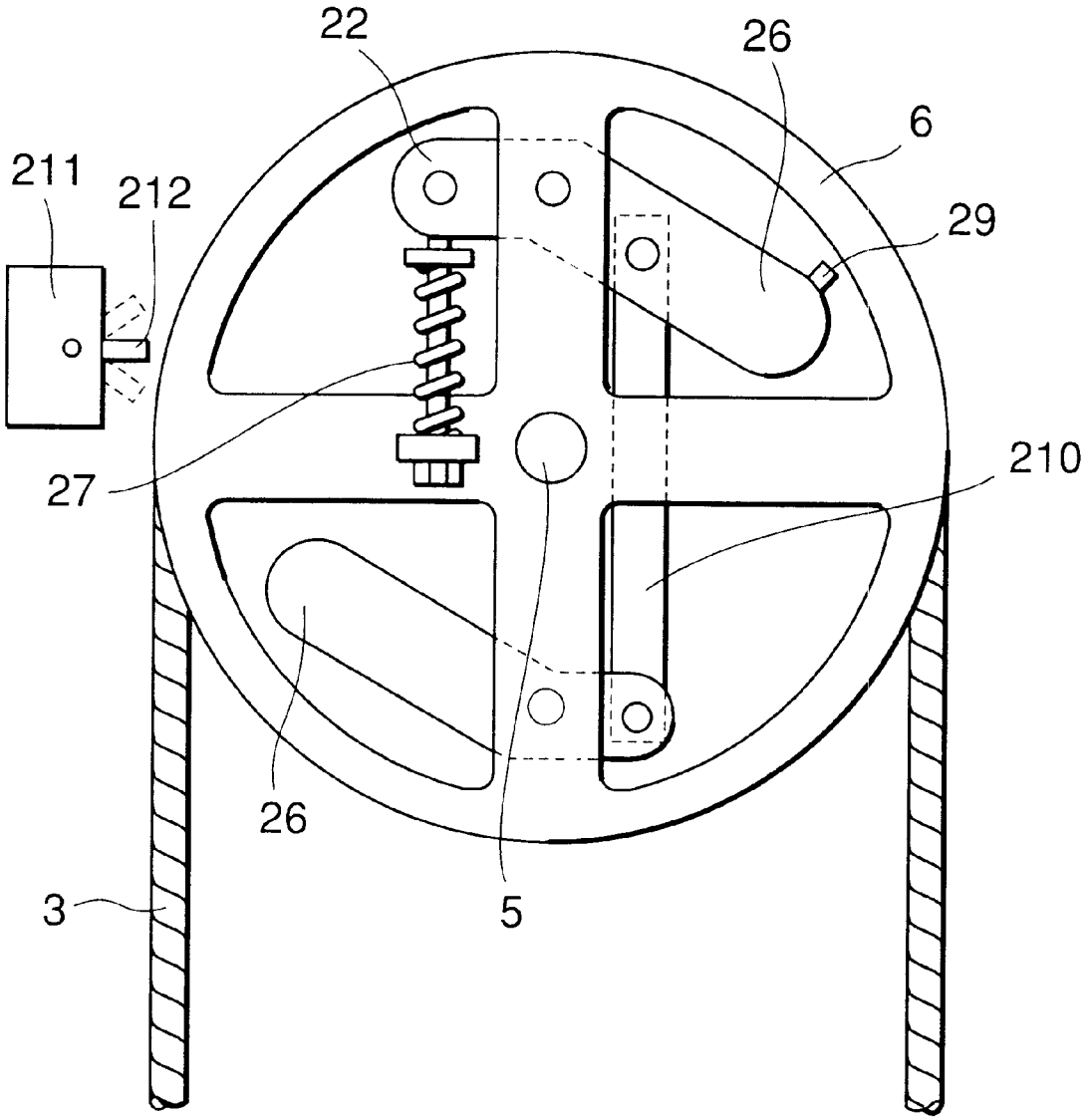
FIG. 6 is a front view of the elevator speed governor in the first embodiment.

FIG. 5 is a longitudinal sectional view showing an elevator speed governor 42 according to the first embodiment of the present invention. FIG. 6 is a front view of a sheave portion shown in FIG. 5. Like components as those shown in the aforesaid drawings will be assigned like reference numerals.

The speed governor 42 has a support member 4, a horizontal shaft 5 rotatably held by the support member 4 via a bearing 56, and a sheave 6 which is secured to the horizontal shaft 5 and on which a curved portion at an upper end of the speed governing rope 3 is wound. The sheave 6 rotates about the horizontal shaft 5 as the car 44 moves up or down. For instance, the sheave 6 rotates in a forward direction when the car 44 descends in the hoistway, while the sheave 6 rotates in a reverse direction when the car 44 ascends in the hoistway.

The speed governor 42 further includes a driving bevel gear 8 that is secured to the horizontal shaft 5 and disposed concentrically with a rotational center of the sheave 6, a first perpendicular shaft 52 rotatably held by the support member 4 via a bearing, and a driven bevel gear 9 that is secured to the first perpendicular shaft 52 and in engagement with the driving bevel gear 8. A torque of the sheave 6 is transmitted to the first perpendicular shaft 52 via the driving bevel gear 8 and the driven bevel gear 9, causing the first perpendicular shaft 52 to rotate.

A second perpendicular shaft 53 is concentric with the first perpendicular shaft 52, and rotatably held by the support member 4 at right above the first perpendicular shaft 52. The second perpendicular shaft 53 is also pivotally held by the support member 4 via a bearing.

Reference numeral 54 denotes a clutch mechanism inserted between the first perpendicular shaft 52 and the second perpendicular shaft 53. The clutch mechanism 54 detects a moving direction of the car 44 mainly from a rotational direction of the sheave 6. The clutch mechanism 54 couples the first perpendicular shaft 52 and the second perpendicular shaft 53 when the car 44 is moving down, while it disengages the first perpendicular shaft 52 and the second perpendicular shaft 53 when the car 44 is moving up.

When the first perpendicular shaft 52 and the second perpendicular shaft 53 are in engagement, the second perpendicular shaft 53 rotates at the same speed as that of the first perpendicular shaft 52. When the first perpendicular shaft 52 and the second perpendicular shaft 53 are separated, the second perpendicular shaft 53 does not rotate even when the first perpendicular shaft 52 rotates.

The clutch mechanism 54 in this embodiment engages the first perpendicular shaft 52 with the second perpendicular shaft 53 when the sheave 6 rotates in the forward direction, while it disengages the first perpendicular shaft 52 from the second perpendicular shaft 53 when the sheave 6 rotates in the reverse direction.

Reference numeral 10 denotes a fly ball speed governing mechanism provided on the second perpendicular shaft 53. Reference numeral 51 is a fly weight speed governing mechanism provided on the sheave 6. The fly ball speed governing mechanism 10 has a configuration as shown in FIG. 5, and has a first stop switch 17 for bringing the hoisting machine 410 to an emergency stop if a first over-speed is detected via the horizontal shaft 5, and a mechanism for actuating a unit 49 for bringing an ascending/descending member to an emergency stop if a second over-speed is detected. The mechanism for actuating the unit 49 for bringing the ascending/descending member to an emergency stop upon detection of the second over-speed will be discussed hereinafter.

The configuration of the fly weight speed governing mechanism 51 is as shown in FIG. 6. The fly weight speed governing mechanism 51 has fly weights 26, a balance spring 27, a link 210, a stop switch 211, and an actuating member 29.

The fly weights 26 are disposed on side surfaces of the sheave 6 such that they face each other via the horizontal shaft 5, and are pivotally attached to the sheave 6. The fly weights 26 are rotationally displaced in a direction in which a weight side thereof is orthogonalized with an axis of the horizontal shaft 5. The balance spring 27 has one end thereof engaged with an anti-weight side of the fly weights 26, while the other end thereof engaged with a side surface of the sheave 6, and resists a displacing action of the fly weights 26 caused by a centrifugal force produced when the sheave 6 rotates.

A link 210 has its both ends disposed on opposite sides from each other with respect to pivoting points of the two fly weights 26. A stop switch 211 mounted on a base 21 has an actuating assembly 212 opposed to the actuating member 29, and cuts off power of the hoisting machine 410 for moving the car 44 up and down. The actuating member 29 provided on the fly weight 26 comes in contact with the stop switch 211 to drive the stop switch 211 if the moving speed of the car 44 exceeds the first over-speed, causing the fly weight 26 to rotate in a direction orthogonal to the axis of the horizontal shaft 5.

The fly weight speed governor according to this embodiment is provided with only the stop switch 211 that stops the hoisting machine 410 upon detection of the first over-speed. The fly weight speed governor 51 does not detect the second over-speed because the emergency stop unit 49 is able to be actuated only when the car 44 is in a descending mode.

In the elevator speed governor 42 configured as described above, the second perpendicular shaft 53 does not rotate when the car 44 moves up. Hence, of the two speed governing mechanisms, only the fly weight speed governing mechanism 51 functions, while the fly ball speed governing mechanism 10 is set to a disabled mode wherein a speed governing operation is suspended. When the car 44 moves down, both the fly ball speed governing mechanism 10 and the fly weight speed governing mechanism 51 function.

Thus, the clutch mechanism 54 may be considered as a transmitting mechanism that transmits the torque of the sheave 6 to the fly ball speed governing mechanism 10 when the sheave 6 rotates in the forward direction, while it stops the transmission of the torque of the sheave 6 when the sheave 6 rotates in the reverse direction.

A description will be given of an elevator wherein a rated speed differs, depending on a moving direction. For example, a rated speed in an ascending mode is set to a value larger than that of a second over-speed (the second over-speed is defined by the rated speed and represented by the code as ASME/ANSI A17.1-1987 SAFETY CODE FOR ELEVATORS AND ESCALATORS) that is determined from the rated speed in the descending mode. In this case, the magnitudes of over-speeds to be detected by a speed governor of this elevator are set so that the first over-speed in the descending mode, the second over-speed in the descending mode, and the first over-speed in the ascending mode are detected in this order, and emergency stop operations of the over-speeds are performed. An arrangement is made so that the first and second over-speeds in the descending mode are detected by the fly ball speed governing mechanism 10, and the first over-speed in the ascending mode is detected by the fly weight speed governing mechanism 51, then the emergency stop operation is performed upon the detection.

Since the fly weight speed governing mechanism 51 controls a higher speed, since it receives the torque from the sheave 6 when the car 44 ascends and also when the car 44 descends. Therefore, if the over-speeds are set in an ascending order of the first over-speed in the descending mode, the second over-speed in the descending mode, and the first over-speed in the ascending mode, then the fly weight speed governing mechanism 51 takes care of the first over-speed in the ascending mode, which is the highest speed in this example.

In this embodiment, when an ascending/descending member moves down, both the fly ball speed governing mechanism 10 and the fly weight speed governing mechanism 51 are enabled. If the descending speed of the car 44 exceeds the rated speed in the descending mode and reaches the first over-speed in the descending mode, then the fly ball speed governing mechanism 10 detects it, and if the car 44 further accelerates and reaches the second over-speed, then this is detected also by the fly ball speed governing mechanism 10.

At this time, the sheave 6 rotates, and the fly weight speed governing mechanism 51 is subjected to a centrifugal force based on the speed of the ascending/descending member. The fly weight speed governing mechanism 51, however, is not actuated because the second over-speed in the descending mode is smaller than the first over-speed in the ascending mode that has been set so that it is detected by the fly weight speed governing mechanism 51.

When the car 44 moves up, the fly ball speed governing mechanism 10 is disabled. Therefore, even if the car 44 accelerates and exceeds an ascending speed equivalent to the first over-speed or the second over-speed in the descending mode before the car 44 reaches a rated speed in the ascending direction, such a speed is not detected. However, the fly weight speed governing mechanism 51 provided on the sheave 6 is subjected to the centrifugal force based on the speed of the ascending/descending member; hence, if the ascending/descending member exceeds a rated speed in the ascending direction and reaches the first over-speed in the ascending direction, then the emergency stop operation is performed.

Thus, an elevator speed governor can be achieved that is capable of performing a necessary stopping operation even if the first over-speed in the ascending direction is different from the first over-speed in the descending direction.

Figure 7:
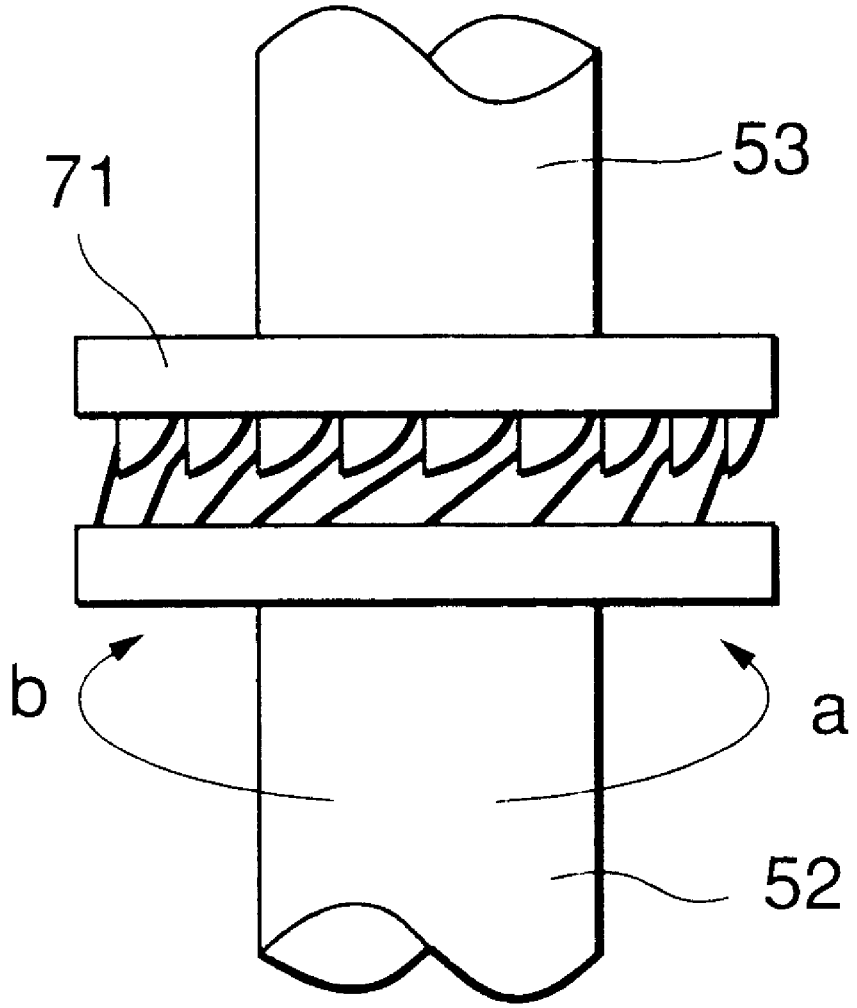
FIG. 7 is an enlarged view of a ratchet mechanism.

As the clutch mechanism 54, one may be used that employs a ratchet mechanism 71, such as a free gear disposed between a rear wheel gear and a rear wheel shaft of a bicycle, a one-way clutch, which is a type of bearing, or a combination of a bolt and a nut as shown in FIG. 7. In the ratchet mechanism 71, when the first perpendicular shaft 52 is accelerated and rotated in a certain direction (indicated by "a" in FIG. 7) with respect to the second perpendicular shaft 53, the second perpendicular shaft 53 rotates at the same angular velocity as that of the first perpendicular shaft 52 owing to the action of the ratchet mechanism 71.

When the first perpendicular shaft 52 decelerates, however, the second perpendicular shaft 53 runs idle, not being subjected to the torque from the first perpendicular shaft 52. When the first perpendicular shaft 52 rotates in an opposite direction (indicated by "b" in FIG. 7) from the rotational direction "a", the second perpendicular shaft 53 is not subjected to the torque from the first perpendicular shaft 52, either.

Furthermore, an arrangement is made so that the first perpendicular shaft 52 rotates in the direction "a" when the car 44 moves down, while it rotates in the direction "b" when the car 44 moves up. Thus, the second perpendicular shaft 53 rotates at an angular velocity corresponding to the speed of the car 44 as long as the car 44 is accelerating downward. Thereafter, even when the car 44 starts to decelerate, the second perpendicular shaft 53 continues to rotate for a while at an angular velocity that is higher than the angular velocity corresponding to the speed of the car 44, rather than decelerating as the first perpendicular shaft 52 decelerates. This is because of an inertial force of primarily the fly ball speed governing mechanism 10. In some cases, even when the car 44 stops once and begins to move down (the first perpendicular shaft 52 beings to rotate in the direction "b"), the second perpendicular shaft 53 continues to rotate in the direction "a" for a while instead of immediately stopping its rotation.

The fly ball speed governing mechanism 10 is subjected to a centrifugal force corresponding to the descending speed of the car 44 only when the car 44 is accelerating. The car 44 first reaches the first over-speed or the second over-speed only when the car 44 is in the middle of acceleration. Hence, the elevator speed governor according to the first embodiment provides the same functions also when the ratchet mechanism 71 described above is employed.

Figure 8:
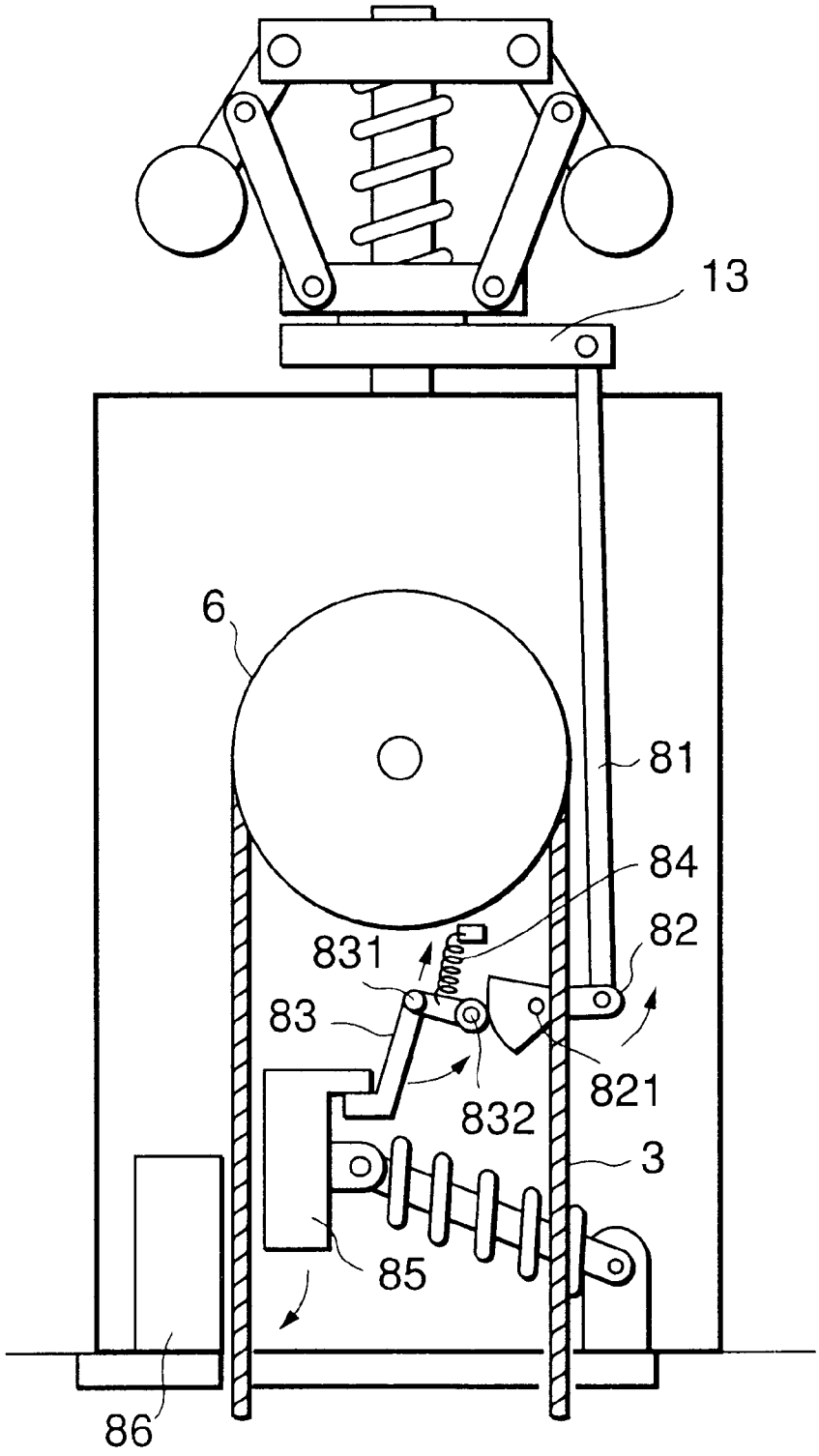
FIG. 8 is an operation diagram of a mechanism that is actuated when a fly ball type speed governor detects a second over-speed.

FIG. 8 shows a mechanism for actuating the emergency stop unit 49 by the fly ball speed governing mechanism 10. The mechanism has a first link 81 coupled to a slide cylinder 13, and a second link 82 having its one end to the first link 81. The second link can be rotated about a shaft 821.

A rotating lever 83 comes in contact with the second link 82 through a roller 832, and the rotating lever 83 can be rotated about a shaft 831. Reference numeral 84 denotes a spring that urges the rotating lever 83. In normal operation, the second link 82 resists the urging force of the spring 84 to thereby prevent the rotating lever 83 from rotating.

However, if the car 44 descends, exceeding the second over-speed in the descending direction, then the slide cylinder 13 rises as the over-speed increases, causing the first link 81 to rise. This in turn causes the second link 82 to rotate about the shaft 821 and disengages from the rotating lever 83. The rotating lever 83 rotates about the shaft 831 due to the urging force of the spring 84 and disengages from a movable shoe 85. Subsequently, the movable shoe 85 drops, and a governor rope 3 is clamped between a fixed shoe 86 and the movable shoe 85. This brakes the descent of the governor rope 3, thus actuating the emergency stop unit 49.

Advantages of the speed governor and the elevator system having the speed governor according to this embodiment will now be described. The speed control when the car 44 ascends is carried out by the fly weight speed governing mechanism 51, while the speed control when the car 44 descends is carried out by the fly ball speed governing mechanism 10. Therefore, even in an elevator in which the first over-speed in the ascending direction of the car 44 is set to be larger than the first over-speed in the descending direction, the stopping operation can be performed at an over-speed in each direction at which the emergency stop operation should be performed.

Moreover, when speeds are set such that they increase in the order of the first over-speed in the descending direction, the second over-speed in the descending direction, and the first over-speed in the ascending direction, the first and second over-speeds in the descending direction can be detected by the fly ball speed governing mechanism 10.

Furthermore, only the fly ball speed governing mechanism 10 is switched between the enabled state and the disabled state, depending on the moving direction of the car 44 or the rotational direction of the sheave 6, and no such switching applies to the fly weight speed governing mechanism 52. Hence, the number of components can be further reduced.

Moreover, in this embodiment, the fly ball speed governing mechanism 10 and the fly weight speed governing mechanism 51 are mechanically configured by the clutch mechanism 54. Therefore, the operation is possible even in case of a power failure or the like.

Furthermore, in this embodiment, the fly weight speed governing mechanism 51 installed on the sheave 6 is employed as the speed governing mechanism for the ascending direction, thus making it possible to configure the mechanism in almost the same size as the conventional fly ball speed governing mechanism.

In this embodiment, the descriptions have been given of the case wherein the over-speeds are set in the ascending order of the first over-speed in the descending direction of the car 44, the second over-speed in the descending direction, and the first over-speed in the ascending direction. This embodiment, however, can be applied also to a case wherein the over-speeds are set in the ascending order of the first over-speed in the descending direction of the car 44, the first over-speed in the ascending direction, and the second over-speed in the descending direction.

In this case also, the first over-speed in the descending direction and the second over-speed in the descending direction are detected by the fly ball speed governing mechanism 10, and the first over-speed in the ascending direction is detected by the fly weight speed governing mechanism 51. In this case, if the car 44 is accelerated, exceeding the first over-speed in the descending direction, then the emergency stop operation is performed by the fly weight speed governing mechanism 51 when the first over-speed in the ascending direction is reached, thus lowering a probability of the descending speed reaching the second over-speed. Thus, a further safer elevator system can be achieved.

In another case wherein the over-speeds are set in the ascending order of the first over-speed in the ascending direction, the first over-speed in the descending direction, and the second over-speed in the descending direction, the fly weight speed governing mechanism 51 detects the first over-speed and the second over-speed in the descending direction, and the fly ball speed governing mechanism 10 detects the first over-speed in the ascending direction to carry out the emergency stop operation. The clutch mechanism 54 must be arranged so that it disengages the transmission of the torque of the sheave 6 to the fly ball speed governing mechanism 10 when the car 44 descends, while it engages the transmission of the torque of the sheave 6 to the fly ball speed governing mechanism 10 when the car 44 ascends.

This embodiment is provided with the fly ball speed governing mechanism 10 and the fly weight speed governing mechanism 51. It is possible, however, to employ other types of speed governing mechanisms.

Furthermore, in this embodiment, only the first over-speed is detected on the speed in the ascending direction. Alternatively, however, an arrangement may be made so that a second over-speed is detected also on the speed in the ascending direction. The mechanism shown in FIG. 2 may be adopted as a mechanism wherein the detection of the second over-speed and the emergency stop operation are performed by the fly weight speed governing mechanism 51.

In this embodiment, the clutch mechanism 54 is provided between the first perpendicular shaft 52 and the second perpendicular shaft 53. Alternatively, however, the clutch mechanism 54 may be provided between the horizontal shaft 5 and the driving bevel gear 8.

Second Embodiment

In the first embodiment, the descriptions have been given of the case wherein the different types of first and second speed governing mechanisms are provided, and the ascending speed is controlled by the first speed governing mechanism, while the descending speed is controlled by the second speed governing mechanism.

In the second embodiment, a case wherein two speed governing mechanisms of the same type are provided will be described.

Figure 9:
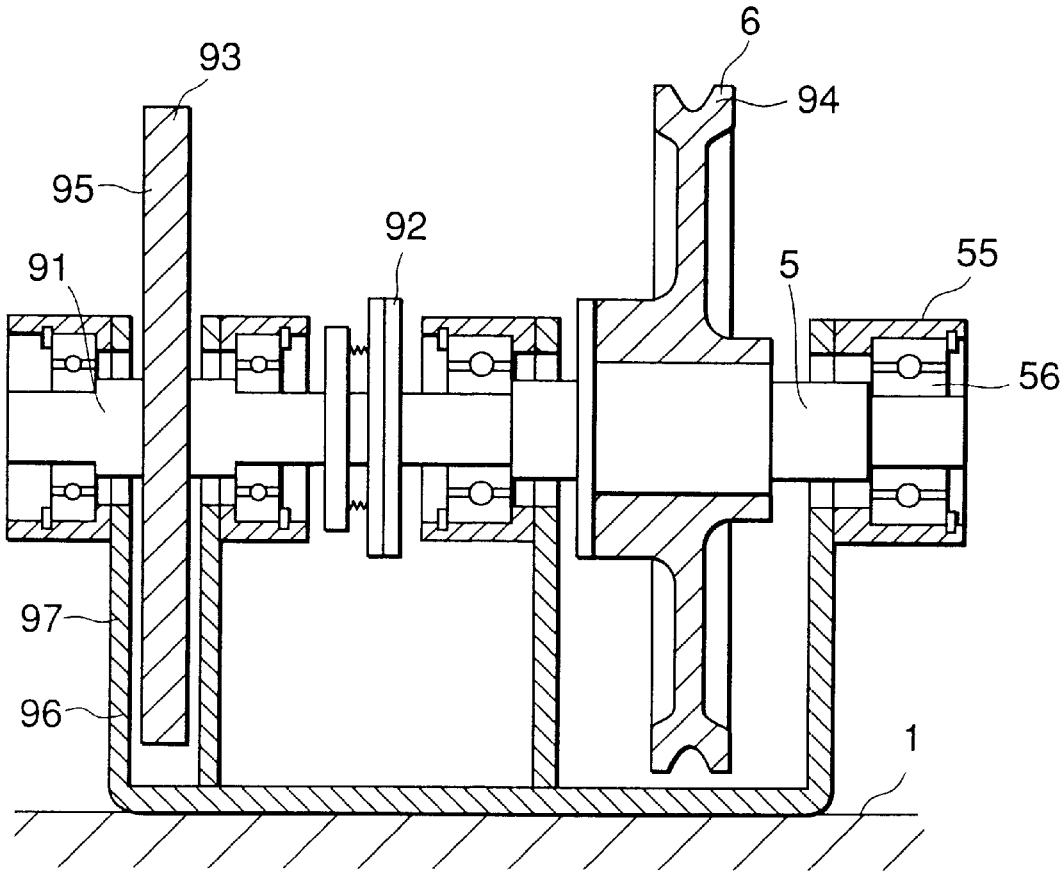
FIG. 9 is a longitudinal sectional view of an elevator speed governor in a second embodiment.

FIG. 9 is a longitudinal sectional view showing an elevator speed governor according to the second embodiment of the present invention. The entire structure of an elevator system in this embodiment is the same as that shown in FIG. 4.

The second embodiment has a support member 97, bearing boxes 55 which are disposed on side walls of the support member 97 and in which bearings 56 are provided, a first shaft 5 rotatably held by one of the bearings 56, and a sheave 6 which is secured to the first shaft 5 and on which an upper end curved portion of a speed governing rope 3 is wound.

A second shaft 91 is concentric with the first shaft 5, and rotatably held by the other bearing 56 right beside the first shaft 5. A clutch mechanism 92 is disposed between the first shaft 5 and the second shaft 91.

As in the case of the clutch mechanism 54 in the first embodiment, the clutch mechanism 92 detects the moving direction of a car 44 mainly from the rotational direction of the sheave 6, and couples the first shaft 5 and the second shaft 91 to cause the second shaft 91 to rotate at the same angular velocity as that of the first shaft 5 only when the car 44 is moving down. Conversely, when the car 44 is moving up, then the clutch mechanism 92 separates the first shaft 5 and the second shaft 91 so that the second shaft 91 remain stationary even when the first shaft 5 rotates.

A rotating wheel 93 secured to the second shaft 91 rotates at the same angular velocity as that of the second shaft 91. Reference numeral 94 denotes a first fly weight speed governing mechanism provided on the sheave 6, and reference numeral 95 denotes a second fly weight speed governing mechanism provided on the rotating wheel 93.

The second fly weight speed governing mechanism 95 has a first stop switch for emergency stop of a hoisting machine 410 upon detection of a first over-speed, and a mechanism for actuating an emergency stop unit 49 of the car 44 upon detection of a second over-speed. The first fly weight speed governing mechanism 94 is equipped only with a second stop switch for bringing the hoisting machine 410 to an emergency stop upon detection of the first over-speed. The configurations of the fly weight speed governing mechanisms are identical to the fly weight speed governing mechanisms shown in FIG. 2 and FIG. 3 except for the aspects that are described in conjunction with this embodiment.

In the elevator speed governor configured as set forth above, when the car 44 moves up, only the first fly weight speed governing mechanism 94 out of the two speed governing mechanisms functions, while the second fly weight speed governing mechanism 95 is placed in a disabled state wherein it does not carry out speed control. Conversely, when the car 44 moves down, both the first fly weight speed governing mechanism 94 and the second fly weight speed governing mechanism 95 function.

The clutch mechanism 92 may be considered to be a transmitting mechanism that transmits the torque of the sheave 6 to the second fly weight speed governing mechanism 95 when the sheave 6 rotates in the forward direction, whereas it disengages the transmission of the torque of the sheave 6 when the sheave 6 rotates in the reverse direction.

Thus, the second fly weight speed governing mechanism 95 detects the first over-speed in the descending direction of the car 44 and the second over-speed in the descending direction. The first fly weight speed governing mechanism 94 detects the first over-speed in the ascending direction of the car 44.

The above description has been given of the case wherein the over-speeds have been set in the ascending order of the first over-speed in the descending direction of the car 44, the second over-speed in the descending direction, and the first over-speed in the ascending direction. The configuration, however, applies also to a case wherein the over-speeds are set in the ascending order of the first over-speed in the descending direction of the car 44, the first over-speed in the ascending direction, and the second over-speed in the descending direction.

For an elevator system wherein the over-speeds are set in the ascending order of the first over-speed in the ascending direction of the car 44, the first over-speed in the descending direction, and the second over-speed in the descending direction, an arrangement will be made so that the first fly weight speed governing mechanism 94 detects the first over-speed and the second over-speed in the descending direction, and the second fly weight speed governing mechanism 95 detects the first over-speed in the ascending direction to carry out the emergency stop operation.

This embodiment is also able to operate even in case of a power failure or the like, since the first and second fly weight speed governing mechanisms 94 and 95 are mechanically constructed using the clutch mechanism 92.

In this embodiment, the description has been given of the case wherein the fly weight speed governing mechanisms 94 and 95 are employed; however, two speed governors of another type may alternatively be used.

Furthermore, in this embodiment, only one over-speed is detected on the ascending speed. Alternatively, however, a plurality of over-speeds may be detected also on the ascending speed.

Third Embodiment

Each of the embodiments set forth above is provided with two fly weight speed governing mechanisms to detect the over-speed in the ascending direction and the over-speed in the descending direction.

As an alternative, two fly ball speed governing mechanisms may be provided, and the over-speed in the ascending direction and the over-speed in the descending direction may be detected by these two fly ball speed governing mechanisms.

The mechanism is configured as follows. A perpendicular shaft of a first fly ball speed governing mechanism is extended, and the perpendicular shaft is coupled to one end of a clutch mechanism. A perpendicular shaft of a second fly ball speed governing mechanism is coupled to the other end of the clutch mechanism. The clutch mechanism is identical to the clutch mechanisms employed in the aforesaid embodiments.

With this arrangement, the second fly ball speed governing mechanism is enabled to detect the over-speed when a car 44 ascends. When the car 44 descends, only the first fly ball speed governing mechanism is enabled, the second fly ball speed governing mechanism being disabled.

Thus, over-speeds can be detected even when the over-speed in the ascending direction and the over-speed in the descending direction are different.

Fourth Embodiment

In the embodiments set forth above, the cases have been described wherein a plurality of speed governing mechanisms responsible for different moving directions of the ascending/descending member are provided. In this embodiment, a description will be given of a speed governor adapted to control different speeds, depending on the moving direction of an ascending/descending member, without providing a plurality of speed governing mechanisms.

Figure 1:
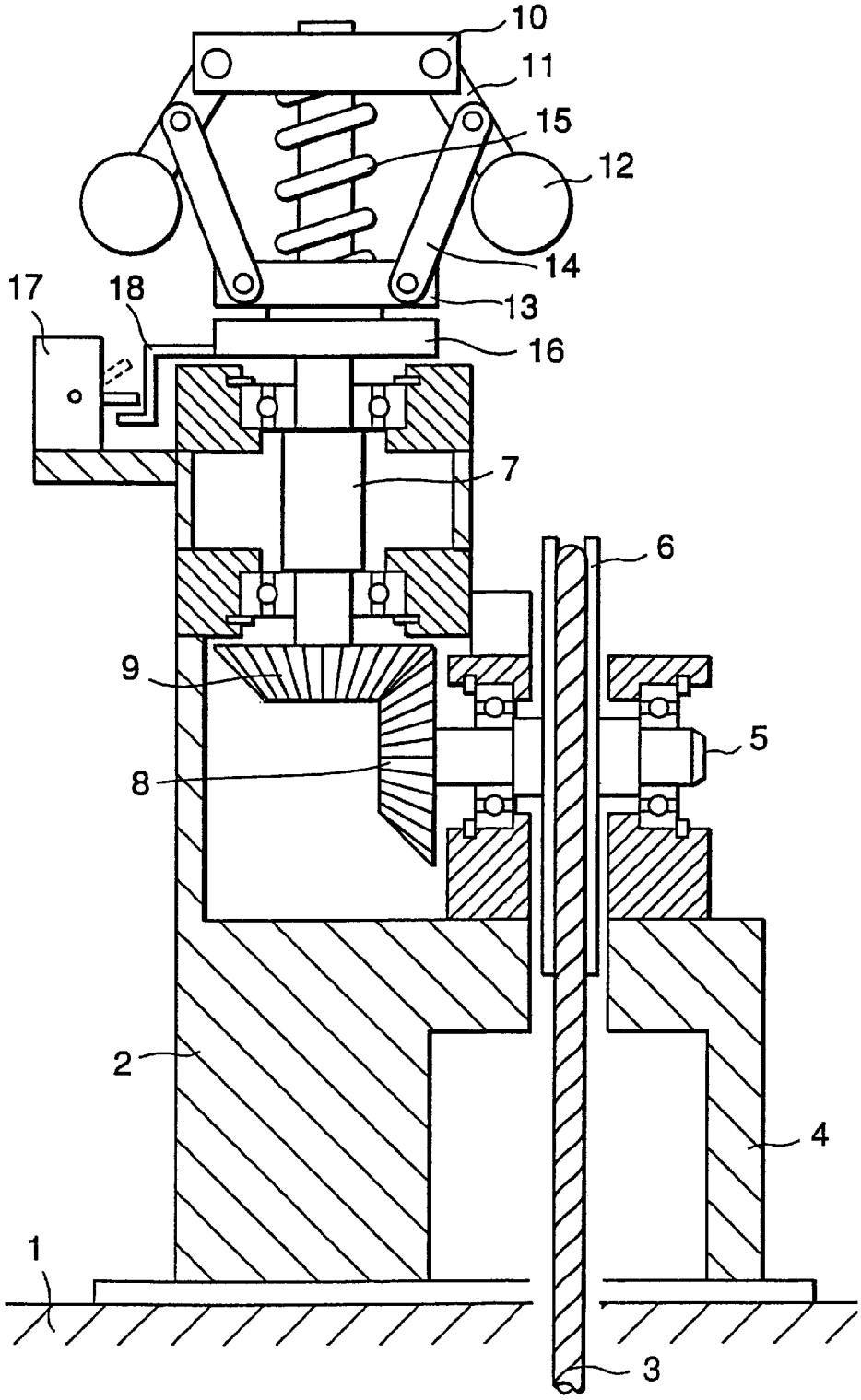
FIG.1 PRIOR ART
FIG. 1 is a longitudinal sectional view of a conventional fly ball type speed governor.
Figure 2:
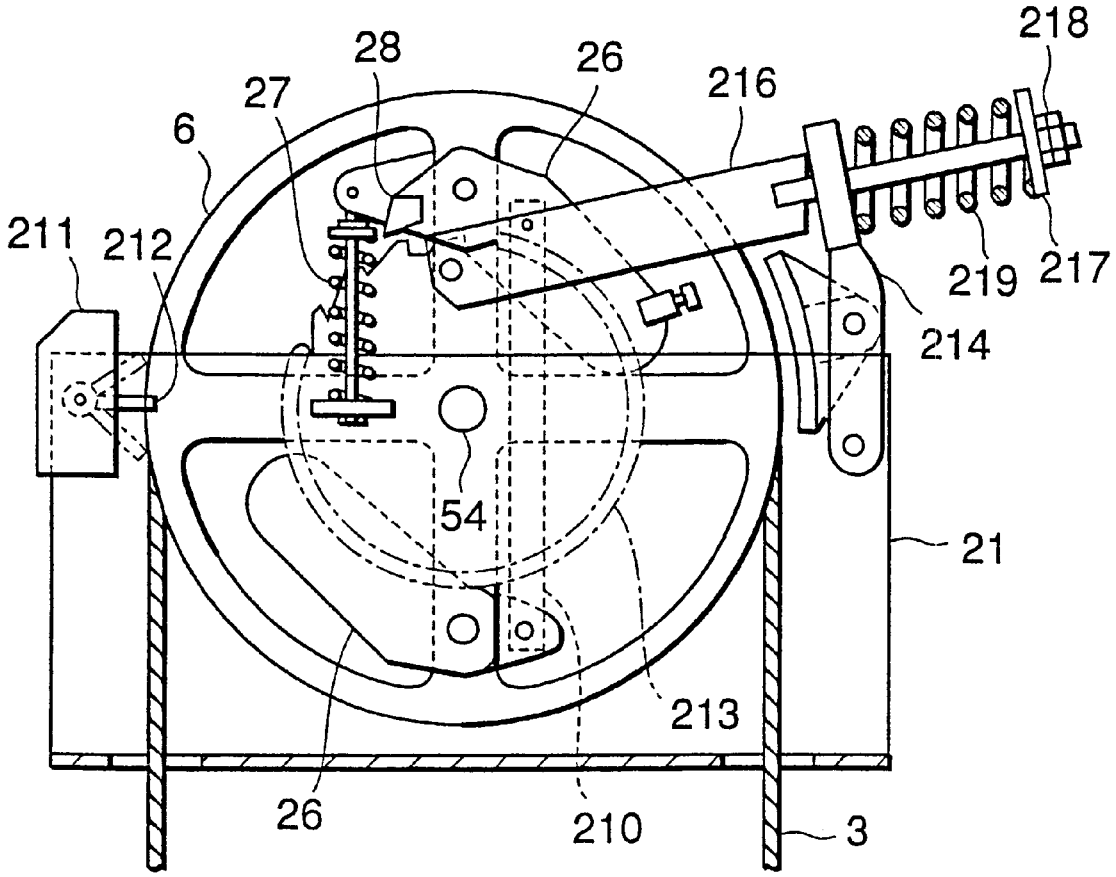
FIG.2 PRIOR ART
FIG. 2 is a front view of a conventional fly weight type speed governor.
Figure 3:
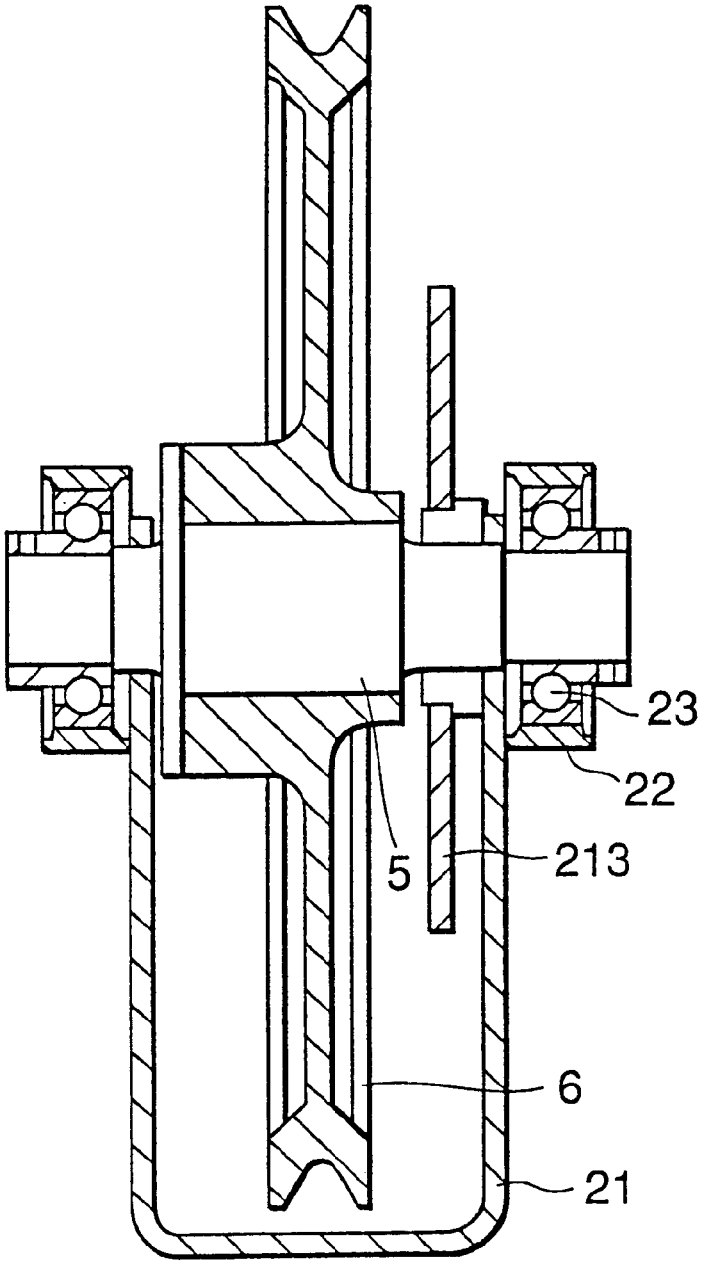
FIG.3 PRIOR ART
FIG. 3 is a longitudinal sectional view of the conventional fly weight type speed governor shown in FIG. 2.

The fly ball speed governor shown in FIG. 1 is equipped with two stop switches 17, and the fly weight speed governor shown in FIG. 2 is equipped with two stop switches 211. Of the two stop switches provided in each governor, one is installed at a position where it is actuated at the first over-speed in the ascending direction of the car 44, while the other one is installed at a position where it is actuated at the first over-speed in the descending direction.

Furthermore, an electric circuit is set so that, even if the stop switch for the descending direction is actuated, the actuated switch is disabled when the car 44 is ascending, whereas the stop switch for the descending direction is enabled again when the car 44 begins to descend following a brief stop.

With this arrangement, different speed control can be conducted according to the moving direction of the car 44 by using the electric circuit, thus obviating the need for providing a plurality of speed governing mechanisms.

Fifth Embodiment

A description will be given of another speed governor that performs different speed control according to the moving direction of an ascending/descending member without the need for providing a plurality of speed governing mechanisms.

An operating lever 18 and an actuating member 29 of a fly ball speed governor are displaced according to an acceleration of the ascending/descending member or the acceleration of a sheave. Hence, stop switches 17 and 211 are moved to different positions according to the moving direction of a car 44. With this arrangement, the stop switches can be actuated at different over-speed depending on whether the car 44 is ascending or descending.

Figure 10:
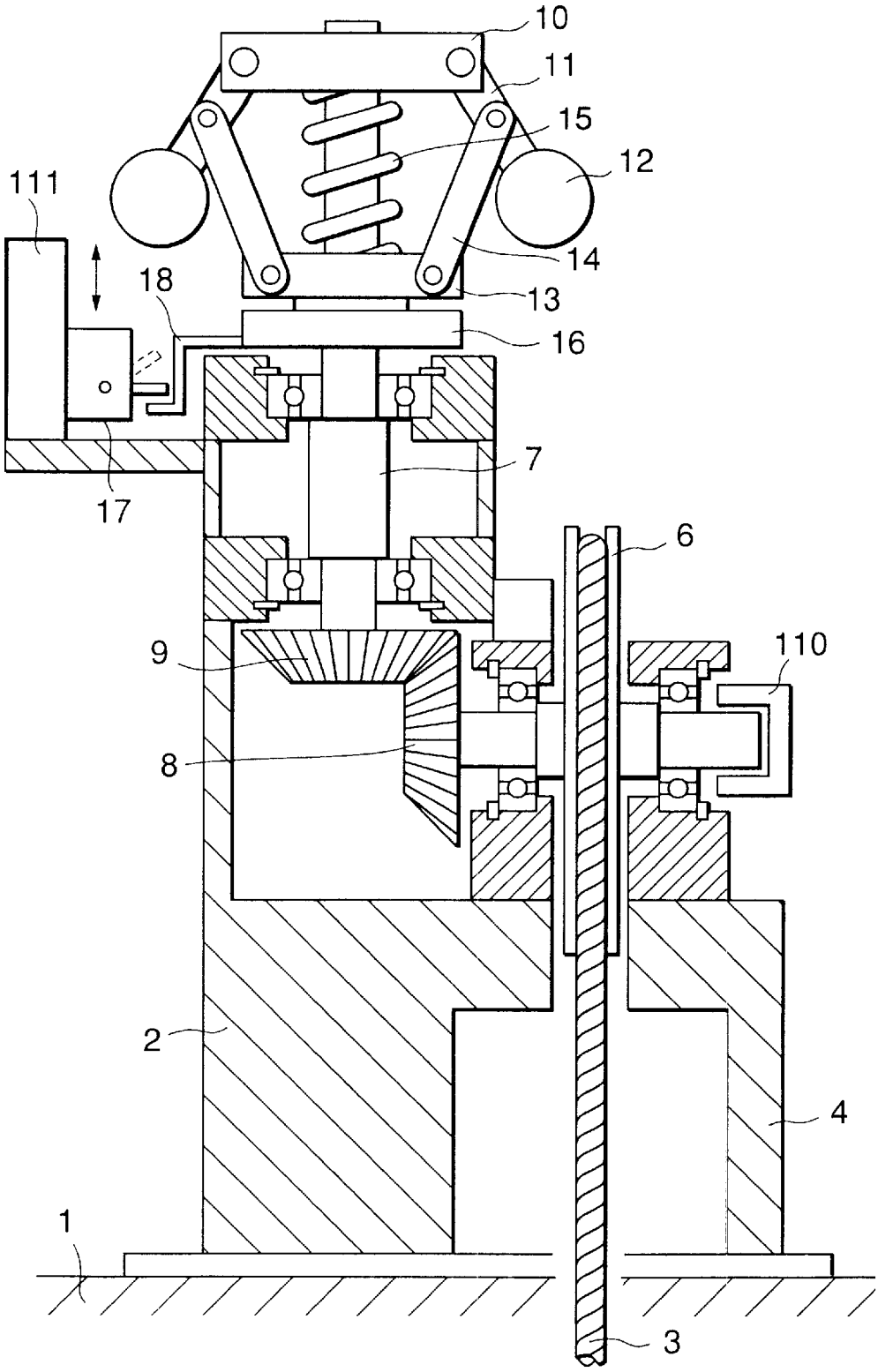
FIG. 10 is a longitudinal sectional view of an elevator speed governor in a fifth embodiment.
Figure 11:
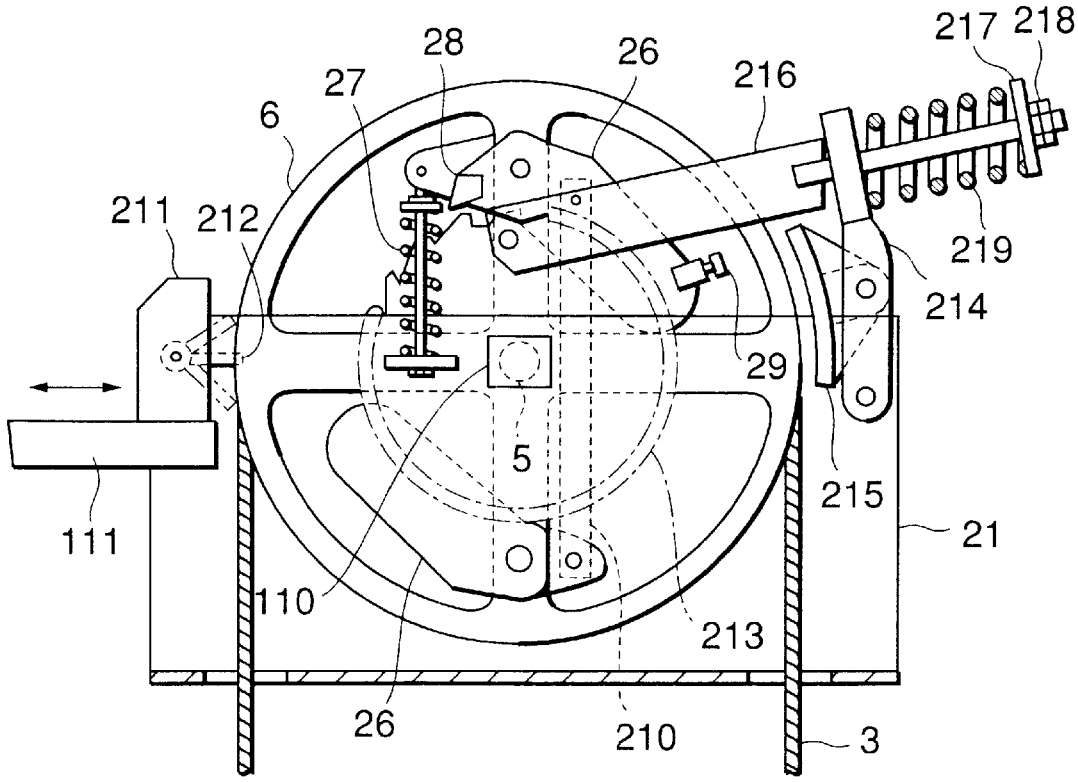
FIG. 11 is a diagram showing another example of the elevator speed governor in the fifth embodiment.

FIGS. 10 and 11 show a structure of the speed governor according to this embodiment.

The speed governor according to this embodiment has a detecting mechanism 110 for detecting the moving direction of the ascending/descending member, and a moving mechanism 111 for moving the positions of the stop switches.

The detecting mechanism 110 detects the moving direction of the car 44, while the moving mechanism 111 moves the positions of the stop switches in the directions indicated by the arrows in the drawings, depending on whether the car 44 is ascending or descending. With this arrangement, over-speeds can be detected even if the first over-speed in the ascending direction is different from that in the descending direction.

Figure 12:
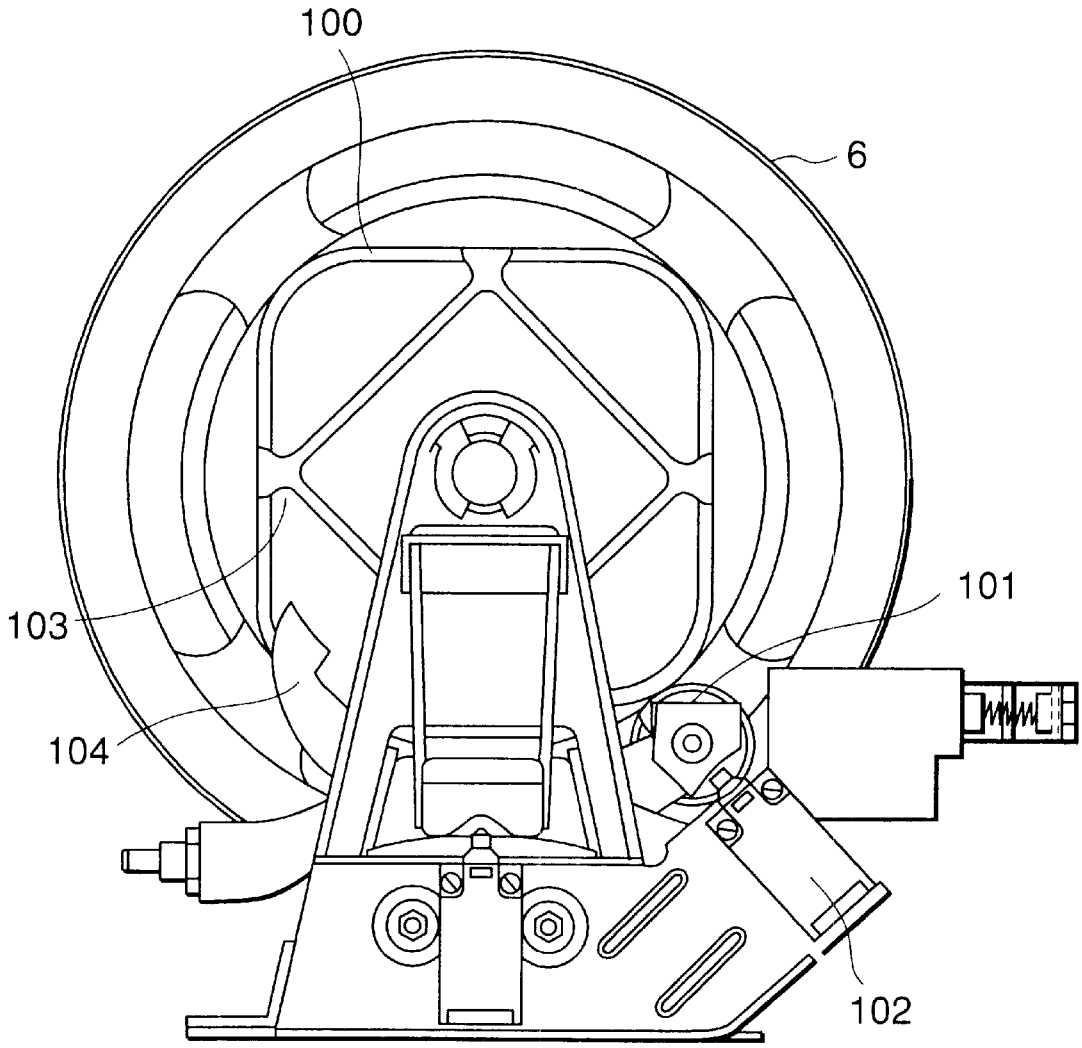
FIG. 12 is a diagram showing another example of an elevator speed governor.

There are other types of speed governors than the fly ball speed governing mechanism and the fly weight speed governing mechanism described in the first through fifth embodiments. Such other types include a speed governor provided by BODE shown in FIG. 12. This speed governor has a sheave 6 on which a speed governing rope is wound, a shaft 5 of the sheave 6, a square frame member 100 secured to the sheave 6, a roller 101 which is in contact with a side surface of the frame member 100 and urged by a spring onto the side surface of the frame member 100, a stop switch 102, a ratchet 103 provided on the frame member 100, and a hook 104 engaging the ratchet.

When the sheave 6 rotates, the roller 101 urged onto the frame member 100 jumps up each time it passes a corner of the square frame member 100. As the rotational speed of the sheave 6 increases, an angle of the jump increases.

When the jumping angle reaches a predetermined value, the stop switch 102 is actuated to cut off power of a hoisting machine. When the angle further increases, the hook 104 engages the ratchet 103, stopping the rotation of the sheave 6. Thus, the movement of a speed governing rope 3 is braked, and an emergency stop unit of the ascending/descending member is actuated, bringing the ascending/descending member to an emergency stop.

Such a speed governor other than the fly ball speed governing mechanism or the fly weight speed governing mechanism may be applied to the first to the fifth embodiments described above.

Thus, the elevator system in accordance with the present invention has: an elevator car that moves in a hoistway; a driving machine unit for moving the elevator car up and down via a cable; a control unit that controls the driving machine unit such that a moving speed at which the elevator car ascends is different from a moving speed at which the elevator car descends; and a speed governing unit for controlling a moving speed of the elevator car; wherein the speed governing unit has a first speed governing mechanism for detecting a moving speed of the elevator car when the elevator car ascends, and a second speed governing mechanism for detecting a moving speed of the elevator car when the elevator car descends; and speed control by the first speed governing mechanism or the second speed governing mechanism is invalidated, depending upon a moving direction of the elevator car. Hence, proper speed detection can be accomplished even when the elevator car moves at different speeds depending on whether it ascends or descends.

The speed governing unit has a speed governing rope connected to the elevator car, a sheave on which the speed governing rope is wound and which rotates in a forward direction or a reverse direction as the elevator car moves up or down, and a transmitting mechanism for controlling engagement and disengagement of transmission of a torque of the sheave to the first speed governing mechanism or the second speed governing mechanism according to a rotational direction of the sheave. This arrangement makes it possible to easily find whether the elevator car is moving up or down.

Furthermore, a first over-speed in an ascending mode and a first over-speed in a descending mode are set as threshold values for starting an emergency stop operation of the elevator car, a value of the first over-speed in the ascending mode and a value of the first over-speed in the descending mode are different from each other, and the first speed governing mechanism detects the first over-speed in the ascending mode, while the second speed governing mechanism detects the first over-speed in the descending mode. Thus, the first over-speeds of the elevator car in the ascending mode and the descending mode can be set to different values, permitting a higher degree of freedom in setting the first over-speeds.

Moreover, a second over-speed in the descending mode is set to a value as a threshold value for starting the emergency operation of the elevator car that is larger than the value of the first over-speed in the descending mode, and the second speed governing mechanism detects the second over-speed in the descending mode. This arrangement improves safety in the descending mode.

Furthermore, the first over-speed V1 in the ascending mode, the first over-speed V2 in the descending mode, and the second over-speed V3 in the descending mode have a relationship represented by V1>V3>V2. Hence, the first over-speeds of different values can be set for the ascending mode and the descending mode, respectively, of the elevator car, thus permitting a higher degree of freedom in setting the first over-speed and also higher safety in the descending mode.

In addition, the first over-speed V1 in the ascending mode, the first over-speed V2 in the descending mode, and the second over-speed V3 in the descending mode have a relationship represented by V3>V1>V2. Hence, the first over-speeds of different values can be set for the ascending mode and the descending mode, respectively, of the elevator car, thus permitting a higher degree of freedom in setting the first over-speed and also higher safety in the descending mode.

Furthermore, the speed governing unit in accordance with the present invention has a speed governing rope, a sheave on which the speed governing rope is wound and which rotates as the speed governing rope moves, a first speed governing mechanism that governs a rotational speed of the sheave, and a second speed governing mechanism that controls a rotational speed of the sheave when the sheave rotates in a forward direction, while it stops speed control when the sheave rotates in a reverse direction. Therefore, it is possible to conduct speed control by the second speed governing mechanism when the sheave rotates in the forward direction, and to conduct speed control by the first speed governing mechanism when the sheave rotates in the reverse direction. This arrangement allows an emergency stop operation to be performed at a different threshold value according to the rotational direction of the sheave.

In addition, the sheave and the second speed governing mechanism are connected via a transmitting mechanism for transmitting the rotation of the sheave, and the transmitting mechanism transmits the rotation of the sheave to the second speed governing mechanism when the sheave rotates in the forward direction, while the transmitting mechanism disengages the transmission of the rotation of the sheave to the second speed governing mechanism when the sheave rotates in the reverse direction. With this arrangement, an emergency stop operation can be performed at different threshold values according to the rotational direction of the sheave, by using a simple structure.

Furthermore, the first speed governing mechanism is a fly weight type speed governor, permitting effective use of a space for the sheave. This makes it possible to reduce the space as compared with other types of speed governors.

Furthermore, the second speed governing mechanism is a fly ball type speed governor, so that an existing speed governor can be utilized.

Moreover, the transmitting mechanism is a clutch coupled between a rotating shaft of the sheave and a rotating shaft of the second speed governing mechanism. With this mechanical switching system, the speed governor can be operated even under a condition where electricity is not available due to a power failure or the like, thus allowing a highly reliable speed governor to be provided.

What is claimed is:

1. An elevator system comprising:

an elevator car that ascends and descends within a hoistway;

a driving machine unit for moving the elevator car within the hoistway via a cable;

a control unit that controls the driving machine unit such that an ascending moving speed at which the elevator car ascends is different from a descending moving speed at which the elevator car descends; and a speed governing unit for controlling ascending and descending moving speeds of the elevator car, wherein the speed governing unit has a first speed governing mechanism for detecting the ascending moving speed of the elevator car, and a second speed governing mechanism for detecting the descending moving speed of the elevator car, the first speed governing mechanism and the second speed governing mechanism being engaged and driven upon descending of the elevator car, and the first speed governing mechanism being engaged and driven and the second speed governing mechanism being disengaged and not driven upon ascending of the elevator car.

2. The elevator system according to claim 1, wherein the speed governing unit comprises:

a speed governing rope connected to the elevator car;

a sheave on which the speed governing rope is wound and which rotates in a forward direction and a reverse direction as the elevator car ascends and descends, respectively; and a transmitting mechanism controlling engagement and disengagement of the second speed governing mechanism in response to reverse direction and forward direction rotation of the sheave, respectively.

3. The elevator system according to claim 1, wherein an emergency stop operation of the driving machine unit is initiated when the ascending moving speed exceeds a first threshold or the descending moving speed exceeds a second threshold, the first and second thresholds being different from each other, and the first speed governing mechanism detects an ascending moving speed exceeding the first threshold, and the second speed governing mechanism detects a descending moving speed exceeding the second threshold.

4. The elevator system according to claim 3, wherein, when the descending moving speed exceeds a third threshold detected by the second speed governing mechanism, an emergency stop operation of the car is initiated, wherein the third threshold is larger than the second threshold.

5. The elevator system according to claim 4, wherein the first threshold is V1, the second threshold is V2, the third threshold is V3, and V1>V3>V2.

6. The elevator system according to claim 4, wherein the first threshold is V1, the second threshold is V2, the third threshold is V3, and V3>V1>V2.

7. The elevator system according to claim 1, wherein the first speed governing mechanism is a fly weight speed governor.

8. The elevator system according to claim 1, wherein the second speed governing mechanism is a fly ball speed governor.

9. The elevator system according to claim 1, wherein the transmitting mechanism is a clutch coupling a rotating shaft of the sheave to a rotating shaft of the second speed governing mechanism.

10. A speed governing unit comprising:

a speed governing rope;

a sheave on which the speed governing rope is wound and which rotates as the speed governing rope moves;

a first speed governing mechanism that is driven regardless of direction of rotation of the sheave and that controls rotational speed of the sheave when the sheave rotates in a forward direction; and a second speed governing mechanism that is driven only when the sheave rotates in the reverse direction and controls rotational speed of the sheave when the sheave rotates in the reverse direction.

11. The speed governing unit according to claim 10, wherein the sheave and the second speed governing mechanism are connected via a transmitting mechanism for transmitting rotation of the sheave, the transmitting mechanism transmitting the rotation of the sheave to the second speed governing mechanism when the sheave rotates in the reverse direction, and disengages transmission of the rotation of the sheave to the second speed governing mechanism when the sheave rotates in the forward direction.

12. The speed governing unit according to claim 10, wherein the first speed governing mechanism is a fly weight speed governor.

13. The speed governing unit according to claim 10, wherein the second speed governing mechanism is a fly ball speed governor.

14. The speed governing unit according to claim 11, wherein the transmitting mechanism is a clutch coupling a rotating shaft of the sheave and a rotating shaft of the second speed governing mechanism.

15. An elevator system comprising:

an elevator car having ascending and descending moving directions within a hoistway;

a driving machine unit for moving the elevator car within the hoistway via a cable;

a control unit that controls the driving machine unit such that an ascending moving speed at which the elevator car ascends is different from a descending moving speed at which the elevator car descends;

a detecting mechanism for detecting whether the elevator car moving direction is ascending or descending;

a speed governing unit for controlling ascending and descending moving speeds of the elevator car, wherein the speed governing unit has a first speed governing mechanism for detecting the ascending moving speed of the elevator car and including a first stop switch actuated by the first speed governing mechanism when the ascending moving speed exceeds a first threshold, and a second speed governing mechanism for detecting the descending moving speed of the elevator car and including a second stop switch actuated by the second speed governing mechanism when the descending moving speed exceeds a second threshold; and a moving mechanism on which the first and second stop switches are mounted and moving the first and second stop switches relative to the first and second speed governing mechanisms in response to the moving direction detected by the detecting mechanism so that only the first switch can be actuated when the elevator car is ascending and only the second switch can be actuated when the elevator car is descending.

16. The elevator system according to claim 15, wherein the speed governing unit comprises:

a speed governing rope connected to the elevator car; and a sheave on which the speed governing rope is wound and which rotates in a forward direction and a reverse direction as the elevator car ascends and descends, respectively.

17. The elevator system according to claim 15, wherein the first speed governing mechanism is a fly weight speed governor.

18. The elevator system according to claim 15, wherein the second speed governing mechanism is a fly ball speed governor.

* * * * *